US006158367A

United States Patent [19]

Jordan et al.

[11] Patent Number: 6,158,367

[45] Date of Patent: Dec. 12, 2000

[54] APPARATUS AND METHOD FOR AUTOMATICALLY ORIENTING HOSIERY ARTICLES FOR CLOSING TOE ENDS THEREOF

[75] Inventors: Bobby Jordan; Michael R. Wood, both of Burlington, N.C.

[73] Assignee: B. B. & S. Knitting Consultants, Burlington, N.C.

[21] Appl. No.: 09/527,664

[22] Filed: Mar. 17, 2000

Related U.S. Application Data

[60] Provisional application No. 60/124,735, Mar. 17, 1999.

[51] Int. Cl.[7] ..... D05B 33/00

[52] U.S. Cl. ..... 112/470.08; 112/475.12; 112/475.04; 112/475.07

[58] Field of Search ..... 112/470.08, 470.06, 112/470.07, 470.14, 470.15, 475.04, 475.05, 475.07, 475.12

[56] References Cited

U.S. PATENT DOCUMENTS

| | | | |
|---|---|---|---|
| 2,980,917 | 4/1961 | Slane . | |
| 3,520,262 | 7/1970 | Bolles et al. . | |
| 3,941,069 | 3/1976 | Fukuyama . | |
| 4,192,242 | 3/1980 | Haselgrove et al. . | |
| 4,364,320 | 12/1982 | Nakhle et al. . | |
| 4,383,490 | 5/1983 | Hodges . | |
| 4,383,491 | 5/1983 | Hodges . | |
| 4,444,140 | 4/1984 | Moyer . | |
| 4,550,868 | 11/1985 | Hodges et al. . | |
| 4,602,710 | 7/1986 | Bell, Jr. et al. . | |
| 4,609,419 | 9/1986 | Hodges . | |
| 5,014,634 | 5/1991 | Hodges et al. . | |
| 5,040,475 | 8/1991 | Fournier et al. . | |
| 5,165,355 | 11/1992 | Fournier et al. . | |
| 5,398,626 | 3/1995 | Rosso et al. . | |
| 5,531,173 | 7/1996 | Migliorini . | |
| 5,651,483 | 7/1997 | Bell et al. . | |
| 5,771,830 | 6/1998 | Hodges | 112/470.15 |
| 5,904,279 | 5/1999 | Bertram et al. . | |
| 6,003,345 | 12/1999 | Jordan . | |

*Primary Examiner*—Peter Nerbun
*Attorney, Agent, or Firm*—Alston & Bird LLP

[57] ABSTRACT

An apparatus for orienting open-toe sock blanks includes a tube for receiving a sock blank sleeved thereover such that the open toe end of the blank extends beyond the end of the tube, a clamping mechanism for engaging the blank against the tube and for rotating the blank about the tube, a sensor system for detecting one or more predetermined features on the toe end of the blank so that the blank can be rotated to a proper orientation for sewing the toe end closed, and a spreader device that moves into the open toe end of the blank and spreads the toe end into a flattened orientation so that overlying edge portions of the open toe end are generally aligned with each other, and then moves away from the tube to remove the blank from the tube and transport the flattened toe end into an automatic sewing machine for sewing the overlying edge portions of the toe end together.

26 Claims, 4 Drawing Sheets

APPARATUS AND METHOD FOR AUTOMATICALLY ORIENTING HOSIERY ARTICLES FOR CLOSING TOE ENDS THEREOF

CROSS-REFERENCE TO RELATED APPLICATION

This application claims the benefit of the filing date of U.S. Provisional Patent Application Ser. No. 60/124,735 filed Mar. 17, 1999.

FIELD OF THE INVENTION

The invention relates to the manufacture of articles of hosiery. The invention relates more particularly to methods and apparatus for handling articles of hosiery having open toe ends that are to be closed by sewing in a sewing machine, and most particularly to methods and apparatus for automatically orienting the open toe ends of half-hose or socks and positioning them for feeding into an automatic sewing machine.

BACKGROUND OF THE INVENTION

A variety of hosiery articles are formed on circular knitting machinery, coming off the machinery in the form of generally tubular articles. The toe portions of the articles typically are not closed on the circular knitting machine. Instead, the articles are taken off the knitting machine with open toe ends that are subsequently closed by sewing in a sewing machine. In many cases, a shaped heel portion may be knit into the article. Particularly in the case of hosiery with a shaped heel, it is desirable for the seam closing the toe end to be made in a predetermined orientation relative to the heel.

In the case of socks, often the socks are knit to have a shaped toe portion that curves upward from the sole portion toward the instep portion of the sock, and the seam across the toe end desirably is positioned such that it is above, or at least is not below, the toes of the wearer. The term "socks" hereinafter will be used to refer to hosiery articles that do not extend above the knee of the wearer when in the fully extended position of normal use, and which are knit from relatively coarse yams. Included in the category of "socks" are crew socks, mid-calf socks, knee-high socks, sports socks, and the like. Such socks are typically knit with less than about 700 stitches per square inch. In socks having shaped toe portions and/or shaped heel portions, it is desirable for the seam closing the toe end to extend generally across the toes. To achieve this result, it is necessary for the open-toe sock blanks to be fed into the toe-closing sewing machine in a particular orientation.

The process of feeding open-toe sock blanks into toe-closing sewing machines has been performed manually in many manufacturing plants. In other cases, an automated device for feeding the blanks into the sewing machine has been used, but in all of the known devices in widespread commercial use it has still been necessary for a human attendant to orient the blanks properly on the feeding device. The need for manual intervention by human attendants is obviously undesirable from the standpoint of productivity and efficiency of the manufacturing operation.

In the manufacture of women's nylon hose and the like, efforts have been made to automate the entire process of properly orienting the open-toe hose blanks and feeding the oriented blanks into the sewing machine. For example, Detexomat Machinery Limited of the United Kingdom has developed machines that orient nylon hose blanks and feed them into a seamer. An example of such a machine is described in U.S. Pat. No. 4,383,491. The machine is a rotary device having ten tubular carriers on which hose blanks are sleeved. The tubular carriers are mounted on a rotary turret, which rotates to transport each carrier to each of ten stations arranged about the periphery of the turret. Each carrier includes a pair of reciprocally movable finger blades that extend radially outward from diametrically opposite sides of the tubular carrier. At a first station, an operator loads a hose blank onto the carrier disposed at the first station so that the hose blank is sleeved over the tubular carrier and the finger blades. The turret then rotates to transport the hose blank to the second station having a wind-on roller that engages the hose blank and is driven to draw the blank fully onto the carrier, the roller being disengaged from the blank when a photosensor detects the toe end of the blank on the carrier. The hose blank is then advanced to the third station having a positioner that longitudinally positions the toe end of the blank on the carrier with the aid of a photo-sensor that detects when a discernable feature of the toe end becomes longitudinally aligned with the photo-sensor. The blank is then advanced to the fourth station, where the blank is positioned rotationally so that the toe end is in a predetermined orientation relative to a clamp means that will later clamp the toe end for seaming the toe end. The rotational position of the blank is controlled by a positioning means that frictionally engages the blank on the tubular carrier and rotates the blank about the carrier and the finger blades. Various positioning means that are moved into and out of engagement with one side of the hose blank are disclosed, including a padded roller driven about an axis parallel to the axis of the tubular carrier, a driven belt looped about a pair of rollers, and a bar that is driven tangentially relative to the tubular carrier. The positioning means is disengaged from the blank when a photo-sensor detects an indicating mark on the hose blank. The patent states that the indicating mark can be knitted into the hose using a contrasting thread. The machine includes a seamer at another station for closing the toe ends of the hose blanks.

The machine described in the '491 patent is a relatively complicated and expensive piece of equipment, and yet still requires a human attendant to load hose blanks onto the carriers. The machine is intended to be a replacement for a separate sewing machine, but likely would cost considerably more than a simple sewing machine that is dedicated to closing toe ends of hosiery articles. Moreover, the finger blades used for spreading the hose blanks for seaming may allow a relative smooth-knit fabric such as nylon hose to freely rotate about them when orienting the blanks, but with a coarser-knit fabric such as typically used in socks it is anticipated that the finger blades may not allow free rotation of the sock blanks. The roller, belt, or bar used for rotating the hose blanks about the tubular carriers and finger blades engages only a small fraction of the circumference of the blanks; accordingly, if there is any resistance of the blank to rotation about the carrier and finger blades, it is expected that the blank would stretch and deform, thereby compromising the accuracy with which the blank can be rotationally positioned for seaming.

What is needed is an automated apparatus and method for orienting the open toe ends of socks for sewing in a sewing machine. Preferably, the apparatus and method should be readily adaptable for use with existing sewing machines.

SUMMARY OF THE INVENTION

The above needs are met and other advantages are achieved by the present invention, which provides methods and apparatus for automatically orienting and positioning an open toe end of a tubular sock blank so that the toe end can be closed in an automatic sewing machine. The invention is particularly applicable to socks of the type having an extended toe portion that extends axially beyond the remainder of the toe end. In accordance with one embodiment of the invention, the apparatus comprises a tube for supporting the sock blank sleeved thereover such that the sock blank extends lengthwise along a longitudinal axis of the tube with the toe end opened up into a generally tubular shape extending beyond an end of the tube. The apparatus includes at least one clamp member rotatable with respect to the tube and operable to engage the sock blank on the tube and to rotate the sock blank and the toe end thereof about the longitudinal axis of the tube. A sensor system is positioned proximate the end of the tube and is operable for detecting at least one predetermined feature of the toe end and for providing a signal upon detection of the feature by the sensor system. The apparatus also includes a processor arranged to receive the signal from the sensor system and signals from the actuator and to control the rotation of the clamp member in response to said signals so as to position the toe end such that the extended toe portion is in a proper orientation relative to a spreader device of the apparatus. The spreader device is operable to move into the open toe end of the sock blank to a position spaced from the end of the tube and to grip opposite portions of the toe end on either side of the extended toe portion and move the opposite portions apart along a transverse axis to spread the toe end of the sock blank into a flattened configuration having the edge of the extended toe portion overlying and generally aligned with the opposite edge of the sock blank at the toe opening. The spreader device is further operable to remove the sock blank from the tube and to move the sock blank to an automatic sewing machine for feeding the flattened toe portion of the sock blank thereinto.

In a particular embodiment of the invention, the sensor system comprises an optical sensor and an optical target one of which is disposed inside and the other of which is disposed outside the open tubular-shaped toe end of the sock blank to define a line of sight therebetween. The sensor and the target are positioned axially with respect to the toe end such that rotation of the sock blank causes the extended toe portion to block the line of sight in some rotational positions of the sock blank and to move free of the line of sight in other rotational positions of the sock blank, the sensor system thereby detecting a rotational position of the toe portion relative to the transverse axis along which the spreader device spreads the toe end. Advantageously, the sensor detects when one edge of the toe portion breaks the line of sight in a first rotational position of the sock blank and when an opposite edge of the toe portion breaks the line of sight in a second rotational position of the sock blank, and the processor is operable to determine a properly oriented position of the sock blank based on the first and second rotational positions. The one of the sensor and target that is disposed inside the toe end of the sock blank advantageously can be mounted on a member of the spreader device.

The spreader device preferably has a pair of spreader fingers that are movable between collapsed and spread positions toward and away from each other in a defined plane of movement. The spreader device is movable axially relative to the tube for insertion of the spreader device into the open toe end of the sock blank with the fingers in the collapsed positions and with the defined plane of movement of the fingers aligned with the transverse axis, after which the fingers are spread apart to spread and flatten the open toe end of the sock blank. Preferably, the spreader device is mounted on a conveyor device so as to be movable in a direction generally transverse to the axis of the tube for carrying the spread and flattened sock blank to an automatic sewing machine.

In a further embodiment of the invention, the clamping mechanism includes a pair of clamp members mounted on a structure that coaxially surrounds the tube and is rotatably driven about the tube axis. The clamp members are movable generally radially with respect to the tube to engage the sock blank from generally opposite sides thereof. Preferably, each clamp member has an arcuate friction surface for engaging a circumferential sector of the sock blank. Accordingly, the sock blank is gripped over a major circumferential extent of the blank, which effectively prevents significant stretching or deformation of the blank as it is rotated for orienting the toe portion for sewing.

The invention in a further aspect is adapted for use with a sock blank having a pair of handles respectively attached to two diametrically opposite portions of the open toe end located on either side of the extended toe portion, as described in U.S. Pat. No. 6,003,345, the disclosure of which is incorporated herein by reference. The handles can be provided by attaching a bridge between two diametrically opposite portions of the toe end extending across the toe opening, and severing the bridge at about its midpoint. The bridge can be knit into the sock blank on a circular knitting machine. In an embodiment of the invention according to this aspect, the spreader device includes a pair of grippers operable to grip each of the handles and to move apart along the direction of the transverse axis for spreading and flattening the sock blank for sewing. The handles can be used as a "fine-tuning" adjustment of the rotational position of the toe end after the toe end has been approximately positioned in proper orientation by detecting features on the toe end as previously described.

BRIEF DESCRIPTION OF THE DRAWINGS

The above and other objects, features, and advantages of the invention will become more apparent from the following description of certain preferred embodiments thereof, when taken in conjunction with the accompanying drawings in which.

DETAILED DESCRIPTION OF THE DRAWINGS

The present invention now will be described more fully hereinafter with reference to the accompanying drawings, in which preferred embodiments of the invention are shown. This invention may, however, be embodied in many different forms and should not be construed as limited to the embodiments set forth herein; rather, these embodiments are provided so that this disclosure will be thorough and complete, and will fully convey the scope of the invention to those skilled in the art. Like numbers refer to like elements throughout.

Figure 1A:
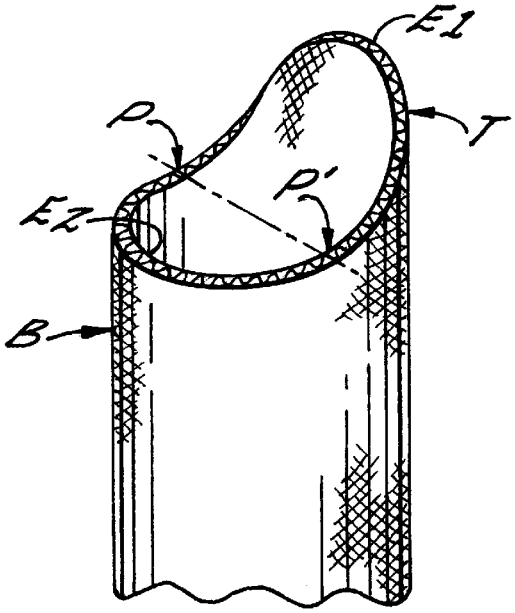
FIG. 1A is a perspective view of a sock blank with the open toe end having an extended toe portion.
Figure 1B:
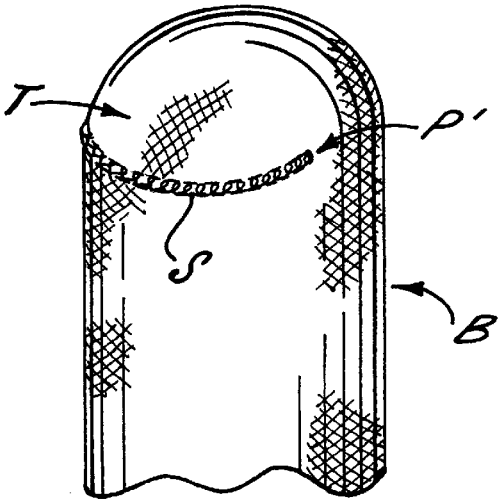
FIG. 1B is a view similar to FIG. 1A showing the toe portion having been closed by sewing along a transverse sew line.

FIGS. 1A and 1B depict the toe end of a sock blank B in respectively open-toe and closed-toe configurations. The sock blank B typically will have been formed on a circular knitting machine and taken off the machine with the toe end still open as in FIG. 1A The illustrated sock blank B is of the type having an extended toe portion T for forming a shaped toe region. When finishing the sock, the extended toe portion T is manipulated so that the edge E1 of the extended toe portion overlies and is aligned with the opposite edge E2 that lies generally diametrically opposite the edge E1. The edges E1 and E2 each extends about halfway around the circumference of the toe opening O and the two edges join each other at diametrically opposite points P and P'. The edge E1 of the extended toe portion T, over most of its circumferential extent, protrudes axially beyond the opposite edge E2 when the open toe end is opened up into a tubular configuration as in FIG. 1A. To close the toe end, the two edges E1 and E2 are sewn together along a sew line S as depicted in FIG. 1B. Socks with such shaped toe regions are well known and hence are not further described in detail.

In many textile mills the sock blanks have typically been manually inserted into a sewing machine that closes the toe ends, a worker performing the task of properly orienting the extended toe portion relative to the remainder of the sock and flattening the toe end and aligning the edges so that the shaped toe region of the sock is properly formed. The present invention seeks to automate this process so that the manufacturing operation is less labor-intensive and hence more efficient. In accordance with the present invention, the sock blank is supported in a tubular configuration and is rotated about its longitudinal axis, and sensors detect the orientation of the sock blank by detecting the extended toe portion, which protrudes axially beyond the remainder of the toe end of the blank. The sock blank is rotated to a predetermined rotational orientation so that the open toe end can be spread into a flattened configuration having the edge of the extended toe portion overlying and aligned with the opposite edge of the toe opening. The sock blank is then transported in this oriented and flattened condition to a sewing machine and the toe end is sewn closed.

Figure 2:
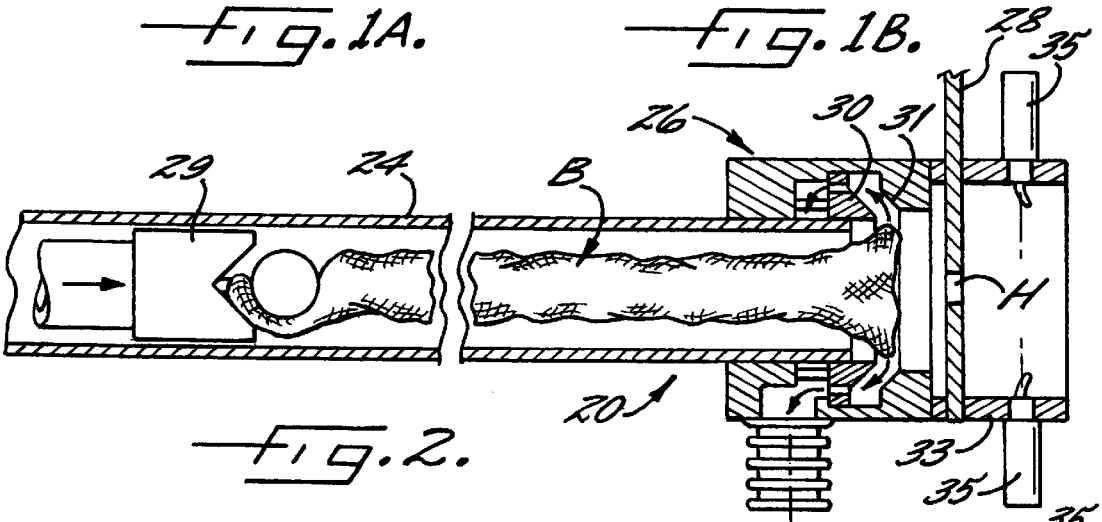
FIG. 2 is a sectioned side elevation of a portion of an apparatus in accordance with the present invention for inverting a sock blank over a tube, the sock blank being shown in an initial position just as the top or cuff end of the blank is being withdrawn from the tube.

FIGS. 2 through 9 are sequential views illustrating an apparatus and method in accordance with one embodiment of the invention. The apparatus 20 includes an inner tube 24 and an outer vacuum and gripping device 26 that coaxially and sealingly surrounds the inner tube 24 and is axially movable relative thereto. Although not depicted in the drawings, the apparatus 20 also can include a system of suction tubes and suitable vacuum sources and valves for suctioning a sock blank B from a bin or the like in which a plurality of sock blanks are disposed, and transporting the sock blank into the inner tube 24 in an axially elongated configuration as shown in FIG. 2. Suitable suction tube systems are shown, for example, in U.S. Pat. Nos. 5,040,475 and 5,165,355, the disclosures of which are hereby incorporated herein by reference. A ball-type gripper device 29 generally of the type disclosed in the '475 patent is disposed in the inner tube 24 for gripping one end of the sock blank after the sock has been suctioned into the inner tube, as shown in FIG. 2. The ball-type gripper device 29 is axially movable as a unit relative to the inner tube 24 for moving the sock blank for purposes to be described below.

Once the sock blank B has been transported into the inner tube 24 and the ball-type gripper device 29 has gripped the end of the sock proximate thereto, a suitable vacuum source (not shown) connected with the vacuum and gripping device 26 is activated to exert a vacuum in the annular space defined between the inner tube 24 and the housing of the vacuum and gripping device 26; the open end of the gripping device 26 is closed by a movable closure member or door 28, and the open end of the inner tube 24 is axially spaced inward from the closure member 28. The closure member 28 includes a small hole H. Accordingly, when the vacuum is turned on for the vacuum device 26, the end of the sock blank B tends to be drawn by the vacuum out the open end of the inner tube 24 as shown in FIG. 2. Air flows through the hole H in the closure member 28, and this air flow tends to open up the end of the sock blank into a tubular shape. This end of the sock blank thus tends to be sucked up into the annular space in the vacuum device 26. At the same time that the vacuum on the vacuum device 26 is turned on, the ball-type gripping device 29 is moved axially forward toward the vacuum device 26, which allows the end of the sock blank to be sucked up into the annular space in the vacuum device 26. The vacuum device 26 includes a movable ring-shaped clamp member 30 mounted within the annular space in the vacuum device 26. The clamp member 30 includes a plurality of holes for allowing air to flow through so that the vacuum is exerted on the sock blank. Once the vacuum to the vacuum device 26 has been turned on and the ball-type gripping device 29 has been moved forward, the clamping member 30 is moved axially forward toward an opposing wall 31 defined by the housing of the vacuum device 26. If the end of the sock blank has been successfully sucked up into the annular space in the vacuum device 26, the clamp member 30 will clamp the end of the sock blank between the clamp member and the opposing wall 31 (see FIG. 3). The vacuum to the vacuum device 26 is then turned off and the ball-type gripping device 29 is deactivated to release its grip on the sock blank.

However, sock blanks generally include a thickened clip at the toe end located axially outward of the desired sew line where the blank will ultimately be sewn to close the toe end. This clip tends to be relatively stiff and more resistant to stretching than the remainder of the sock so that, with an appropriate level of suction in the annular space of the vacuum device 26, the toe end will generally not be drawn up into this annular space, whereas the top or cuff end of the sock will be drawn into the annular space. Thus, after the clamp member 30 has been moved into its clamping position, the vacuum device 26 is moved axially away from the closure member 28 to draw the sock blank (if it has been clamped by the clamp member 30) over the outside of the inner tube 24, the closure member 28 is withdrawn to open the end of the vacuum device 26, and the inner tube 24 is axially extended into the tubular housing 33 in which the closure member 28 is slidably mounted. A pair of air-actuated electrical contact members 32 are mounted in the tubular housing 33. The contact members are movable radially inward by pneumatic actuators 35 so as to project radially inward a sufficient distance that they will make contact with the tube 24 when it is extended into the tubular housing 33, as indicated in phantom lines in FIG. 3. If the toe end of the sock is adjacent the end of the inner tube 24, it will not have been sucked up into the vacuum device and hence the inner tube 24 will be contacted by the contact members 32. This alerts a processor 70 (FIG. 6) that the end of the sock blank has not been successfully inverted over the end of the inner tube 24. Normally, this problem is a result of the sock blank being improperly oriented with the toe end of the sock blank adjacent the end of the inner tube 24, whereas it is desired that the opposite cuff end or top end of the sock blank be adjacent the end of the inner tube before the vacuum device 26 is operated as described above.

Figure 3:
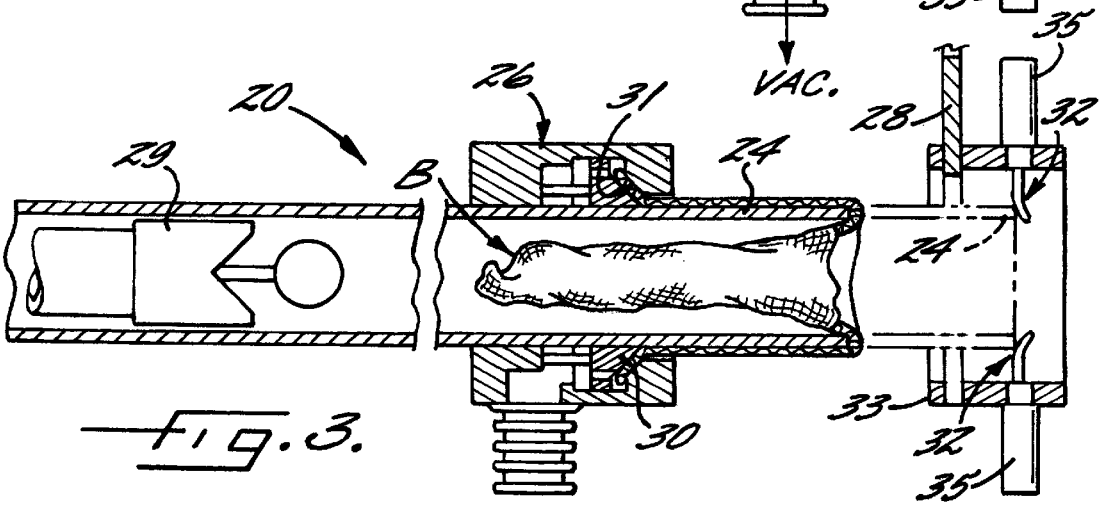
FIG. 3 is a view similar to FIG. 2 representing an instant in time after that of FIG. 2, showing the top end of the sock having been inverted over the end portion of the tube.

Accordingly, if the processor receives an indication from the contact members 32 that the inversion of the sock end over the inner tube was unsuccessful, the processor causes the vacuum device 26 to release the sock blank, and operates suitable vacuum devices connected with appropriate suction tubes to send the sock blank B through a turnaround loop (not shown) that reverses the end-to-end orientation of the sock blank. Such turnaround loops are well known, as shown for instance in the aforementioned '355 and '475 patents, and hence the loop is not further described herein. The sock blank is brought back into the inner tube 24 with the other end of the blank now adjacent the end of the inner tube. The process of gripping one end of the blank with the ball-type gripping device 29 and turning on the vacuum to the vacuum device 26 as described above is then repeated. In most cases, the sock end will be successfully inverted on the second attempt, such that the contact members 32 will not make contact with the inner tube 24, thus indicating that the top end of the sock blank is now inverted over the end of the inner tube 24 as shown in FIG. 3. If the second attempt also fails, as indicated by the contact members 32 making contact with the inner tube 24, then the sock blank is routed out of the tube 24 to a reject station (not shown) and a new sock blank is brought into the tube to start the orientation process again.

Figure 4:
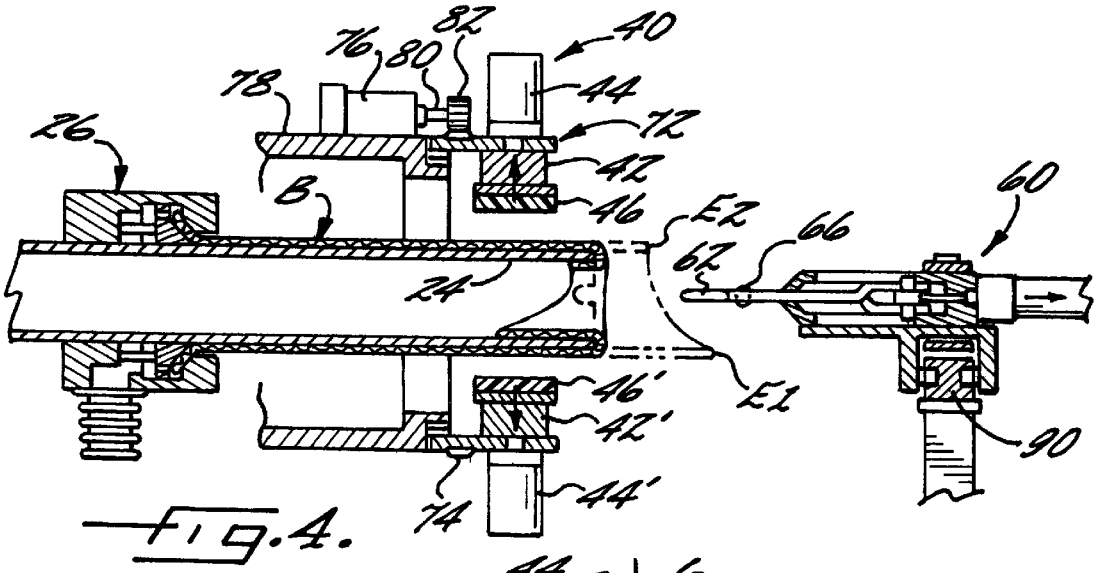
FIG. 4 is a view similar to FIG. 3 depicting a sequence of events occurring after the step of FIG. 3, showing the inverted top end of the sock blank being gripped and pulled along the tube and the tube being extended to bring the end of the tube into proximity with a clamping mechanism, such that the sock blank is inverted over the tube and the open toe end of the sock blank extends beyond the end of the tube.

Once a sock blank has had its top end successfully inverted over the inner tube 24, the inner tube 24 is axially extended outward from the vacuum device 26 until the end portion of the inner tube 24 is generally aligned with a clamping mechanism 40 axially spaced from the vacuum device 26, such that the full length of the sock blank is inverted over the inner tube 24 and the toe end of the blank is positioned adjacent the open end of the inner tube 24 as shown in FIG. 4. To assure that the toe end extends beyond the end of the inner tube 24 rather than being tucked inside the tube, the inner tube preferably is axially extended until the sock blank is entirely outside the inner tube, and is then withdrawn a predetermined distance so that the toe end projects beyond the end of the tube as shown in phantom lines in FIG. 4.

Figure 5:
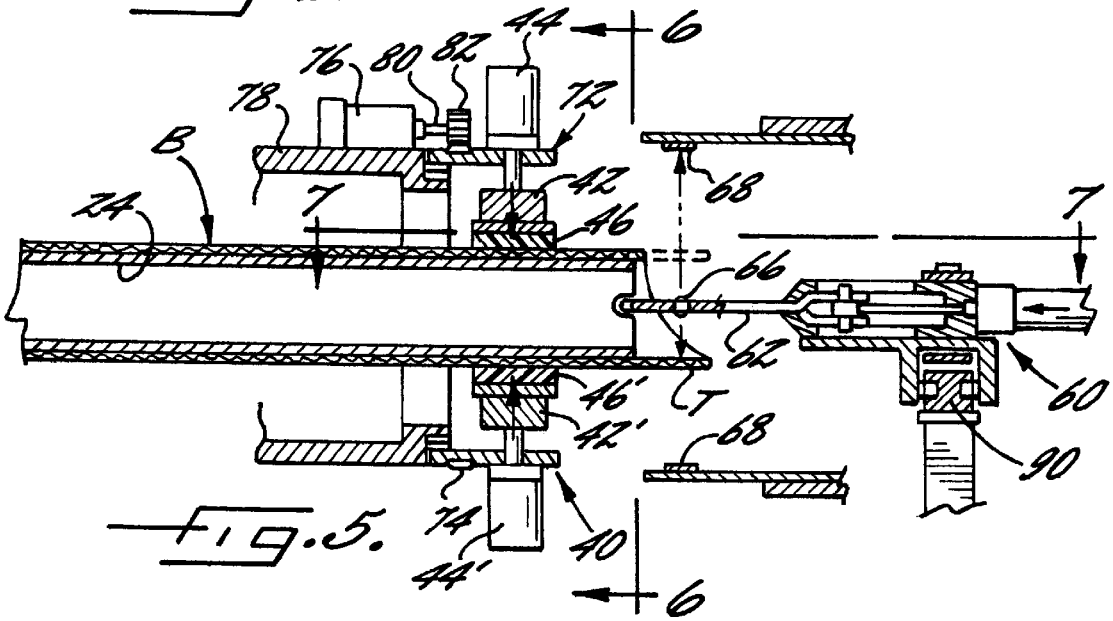
FIG. 5 is a view similar to FIG. 4 representing a sequence of events after the events of FIG. 4, in which the clamping mechanism moves its clamping members radially inwardly to engage the sock blank.

The clamping mechanism 40 is mounted adjacent the housing 33 for the closure member 28 on the opposite side thereof from the vacuum device 26. The clamping mechanism 40 includes a pair of clamping members 42 and 42' that are movable radially inwardly and outwardly by a pair of solenoids 44, 44' or the like. Each clamping member 42, 42' advantageously is formed as a sector of a ring generally matching the curvature of the inner tube 24. The clamping members 42, 42' are moved radially inward to engage the sock blank against the inner tube 24 as illustrated in FIG. 5. The surfaces of the clamping members that engage the sock blank advantageously are formed of a friction material 46 such as rubber or the like.

Figure 6:
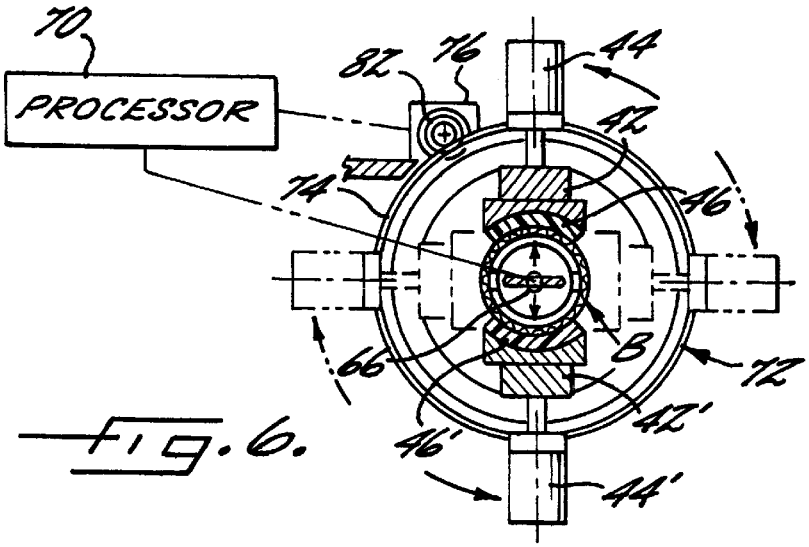
FIG. 6 is a cross-sectional view taken on line 6—6 of FIG. 5, showing the sock blank being rotated about the tube by the clamping mechanism for rotationally orienting the toe end of the blank.
Figure 7:
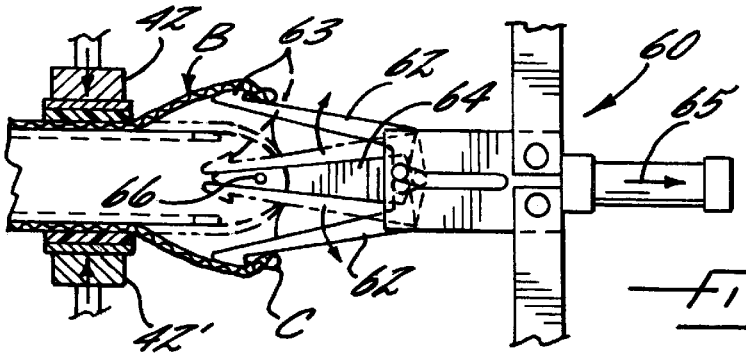
FIG. 7 is a top elevation showing a spreader device spreading and flattening the oriented toe end of the sock blank.

Next, a spreader device 60 is moved into position such that spreader fingers 62 of the device are inserted axially into the open toe end of the sock blank that extends outward from the inner tube 24 as shown in FIG. 5. As best seen in FIG. 7, the spreader device 60 includes a pair of spreader fingers 62 that are movable toward and away from each other in a defined plane, and also includes a stationary member 64 disposed between the spreader fingers. The apparatus further includes a sensor system that includes an optical sensor 66 mounted on the stationary member 64. The sensor 66 advantageously comprises a pair of light emitters that direct beams of light in opposite directions perpendicular to the defined plane in which the spreader fingers 62 move, as illustrated in FIG. 5. The apparatus also includes a pair of detectors or targets 68 positioned on diametrically opposite sides of the toe end of the sock blank and in alignment with the sensor 66. When a light beam from the sensor 66 strikes a target 68, a signal is generated and fed to the processor 70 (FIG. 6). Of course, it will be recognized that the positions of the light emitters and targets could be reversed. The sensor 66 and targets 68 are positioned axially relative to the sock blank such that in some rotational positions of the sock blank the extended toe portion T of the sock blank will block the line of sight between the sensor 66 and one of the targets 68. For instance, FIG. 5 depicts the situation in which the extended toe portion T comes between the sensor 66 and the lower target 68. Because the extended toe portion T extends at most about halfway around the circumference of the sock blank, when one target 68 is blocked by the toe portion T the other target 68 will not be blocked, and vice versa. Accordingly, the sensor system is capable of detecting where the extended toe portion is located relative to the defined plane in which the spreader fingers 62 move.

The apparatus is further operable to rotationally position the sock blank such that the extended toe portion is in a predetermined orientation relative to the spreader device 60. It is desired to orient the sock blank such that the points P and P' located at the junctures between the extended edge E1 and the opposite edge E2 (see FIG. 1A) are aligned along a predetermined transverse axis, which coincides with the defined plane in which the spreader fingers 62 move. To this end, the clamping mechanism 40 is rotatable about the inner tube 24. With reference to FIGS. 4 and 6, the radially movable clamping members 42, 42' are mounted on a rotatable structure 72 that defines an externally toothed ring gear 74 that is coaxial with the inner tube 24. The clamping mechanism includes a motor 76 mounted on a structure 78 that is fixed against rotation. The motor output shaft 80 has a drive gear 82 that meshes with the ring gear 74. Thus, when the motor 76 is driven, the rotatable structure 72 and the clamping members 42, 42' mounted thereon are driven to rotate about the inner tube 24, causing the sock blank to be rotated when the sock blank is engaged by the clamping members.

In accordance with the present invention, the processor 70, which is connected to and controls the motor 76, causes the motor to rotate the sock blank until the lower sensor target 68 is not blocked by the extended toe portion T and the upper target 68 is blocked. The motor is advantageously a servomotor providing position feedback signals to the processor 70. The processor 70 can be a microprocessor such as a personal computer and/or a programmable logic controller (PLC). The sock blank is rotated first in one direction until the upper target 68 just becomes unblocked. The processor 70 stores the rotational position of the motor when the upper target just becomes unblocked; in this position of the sock blank, one edge of the extended toe portion is aligned with the line of sight between the sensor 66 on the spreader device and the target 68. The processor then causes the motor to rotate the sock blank in the other direction so that the upper target 68 again becomes blocked, and rotation is continued until the target just becomes unblocked, and the rotational position of the motor is again stored; in this position of the sock blank, the opposite edge of the extended toe portion is aligned with the line of sight between the sensor 66 and the target 68. The processor averages the two stored positions and causes the motor to move to this average position. This should position the sock blank such that the extended toe portion is approximately centered at the top dead center position of the inner tube 24.

Figure 7A:
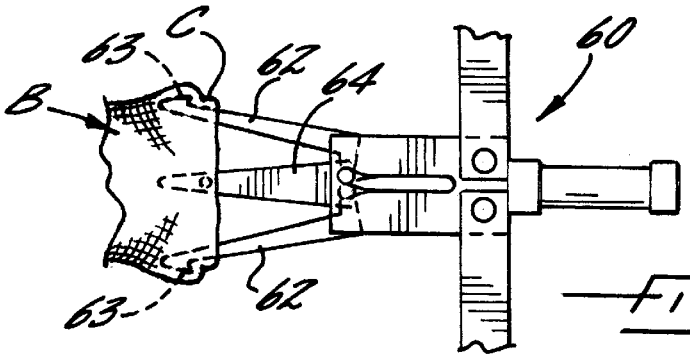
FIG. 7A is a fragmentary top elevation similar to FIG. 7, showing the sock blank in proper position on the spreader fingers with the clip engaged by the recesses of the fingers.
Figure 8:
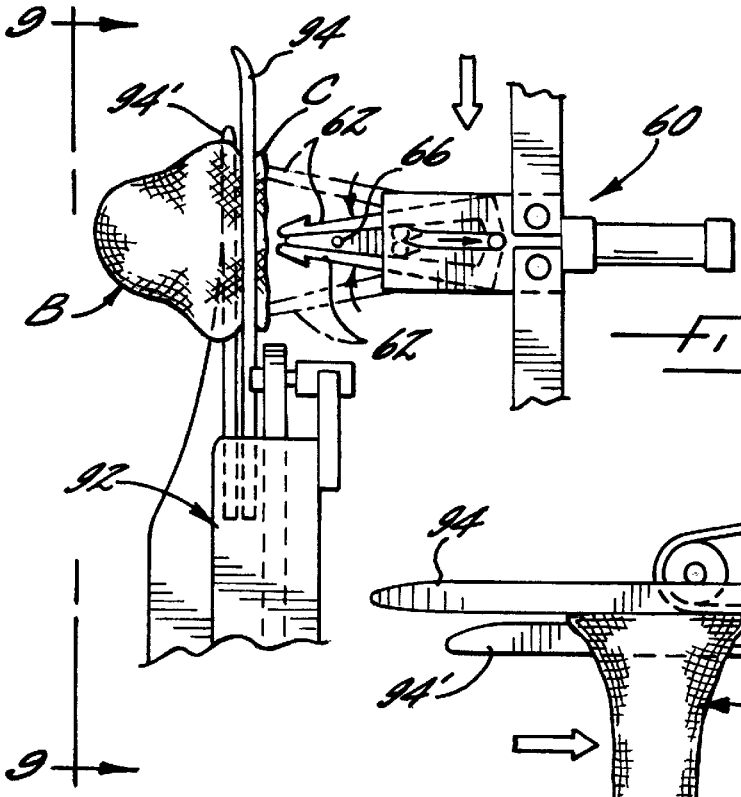
FIG. 8 is top elevation showing the sock blank being transported by the spreader device for feeding into a sewing machine.
Figure 9:
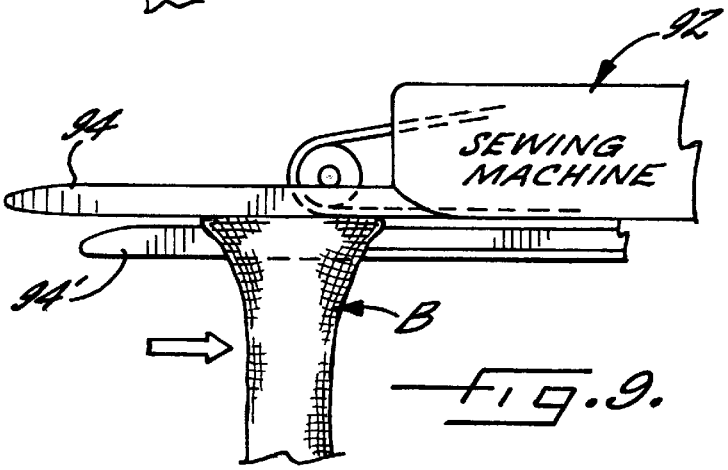
FIG. 9 is a view taken along the line 9—9 of FIG. 8, showing the flattened toe end of the sock blank clamped between a pair of jaws of the sewing machine.
Figure 10:
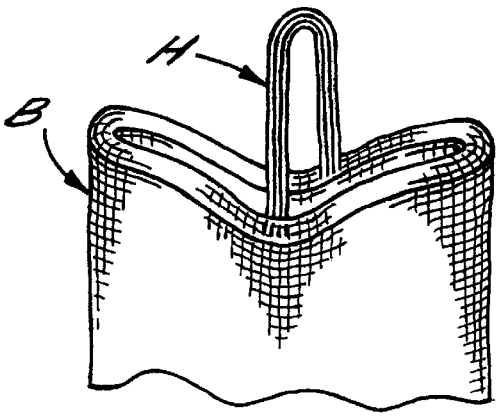
FIG. 10 is a perspective view of a sock blank having a bridge formed across the open toe end thereof for use in an apparatus and method in accordance with another embodiment of the invention.

Once the sock blank is in this position, the spreader device 60 is activated to spread the fingers 62 apart along a transverse axis that is perpendicular to the axis of the tube 24, as shown in FIG. 7, so as to spread the toe end of the sock blank into a flattened configuration. The transverse axis along which the spreader fingers 62 move is preferably perpendicular to the line of sight between the sensor 66 and the targets 68. The free ends of the fingers 62 advantageously are barb-shaped with their laterally outer edges defining undercut recesses 63 spaced a short distance from the ends of the fingers; that is, the lateral width of each finger 62 becomes abruptly smaller a short distance in from the end of the finger. As previously noted, sock blanks typically have a thickened clip C at the very end of the toe portion axially beyond the thinner sew line along which the toe end is to be sewn to close the toe end. The barb-shaped fingers 62 are adapted to locate themselves relative to the sock blank so that the thinner sew line is generally aligned with the recesses 63 in the fingers 62. To this end, while the clamping members 42, 42' of the clamping mechanism 40 are still clamped on the sock blank, the spreader fingers 62 are spread apart as shown in FIG. 7. The spreader device 60 advantageously is axially inserted into the toe end of the sock blank so that the recesses 63 in the fingers are axially inward from the clip and thinner sew line of the blank as depicted in FIG. 7. Once the fingers are fully spread, the spreader device 60 is axially retracted in the direction of arrow 65 in FIG. 7, which causes the fingers 62 to slide relative to the sock blank (which is still clamped by the clamping members 42, 42' so that it cannot move axially) until the thickened clip C encounters the recesses. The clip C is relatively unstretchable compared to the rest of the sock blank and hence will not slide over the barb-shaped ends of the fingers. Thus, the clip C is positively located relative to the fingers 62 as shown in FIG. 7A. Once the clip is so located on the fingers, the clamping members 42, 42' are disengaged from the sock blank.

The fingers 62 effectively grip the two portions P and P' (FIG. 1A) of the toe end that are diametrically opposite each other and are located at opposite ends of the extended toe portion. When the toe end is spread and flattened by moving these two diametrically opposite portions apart, the edge E1 of the extended toe portion tends to become aligned with the edge E2 of the opposite portion of the toe end. In this configuration, the toe end is ready to be sewn along the aligned edges to close the toe end.

To this end, the spreader device 60 is moved away from the inner tube 24, thereby removing the sock blank from the inner tube. As shown in FIG. 4, the spreader device 60 is mounted on a track 90 or other conveyor device that extends transverse to the axis of the inner tube. Arranged along this transverse direction is an automatic sewing machine 92 operable to receive the flattened toe end of the sock blank. The sewing machine includes a pair of clamping jaws 94, 94' operable to clamp the toe end therebetween. The jaws 94, 94' are moved relatively apart in preparation for receiving the sock blank from the spreader device 60. The spreader device 60 is moved to carry the end portions of the spreader fingers 62 and the toe end of the sock blank B between the jaws 94, 94'. The jaws are then closed to clamp the toe end with the aligned edges of the toe end extending parallel to the lengthwise directions of the jaws; the jaws can include cut-out regions for accommodating the fingers 62 so that the spreader device 60 can be retracted from between the jaws in a direction perpendicular to the intended sew line. The sewing machine then sews the edges together to close the toe end. Suitable sewing machines for this purpose are well known and thus are not further described in detail. Although the jaws 94, 94' of the sewing machine are shown as being oriented horizontally, it will be recognized that various other orientations (e.g., vertical) can be used, in which case the spreader device 60 is appropriately movable to orient the sock blank in the proper direction for feeding into the jaws of the sewing machine.

Figure 11:
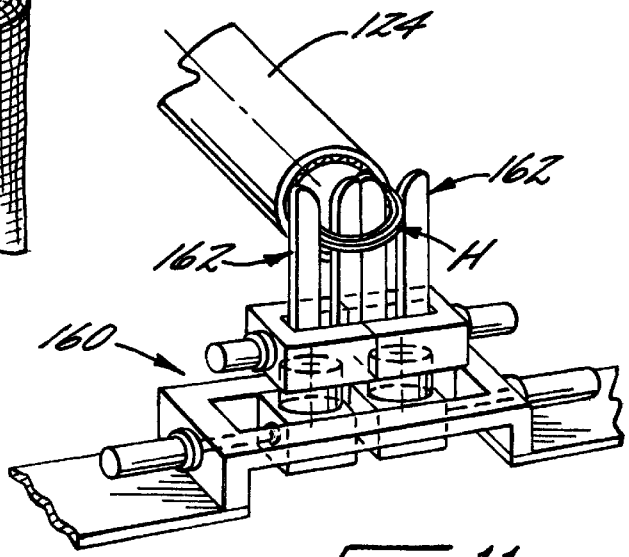
FIG. 11 depicts the bridge being gripped by a spreading device having a pair of grippers for gripping opposite end portions of the bridge.
Figure 12:
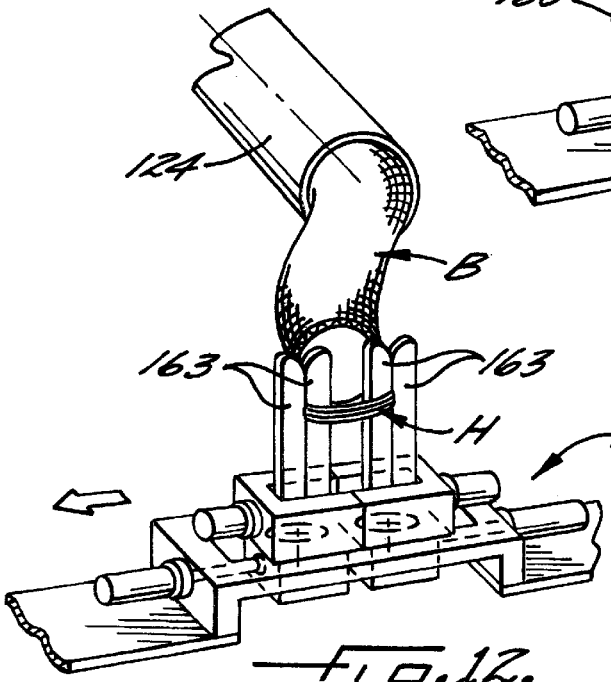
FIG. 12 shows the spreader device moving away from the tube to remove the sock blank therefrom and transport the blank to a sewing machine.
Figure 13:
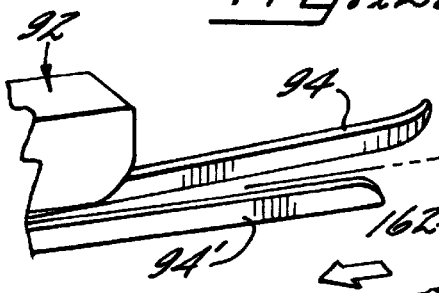
FIG. 13 depicts the bridge being severed and the spreader device pulling the two resulting portions of the bridge apart to flatten the open toe end and feeding the toe end into the sewing machine.
Figure 13:
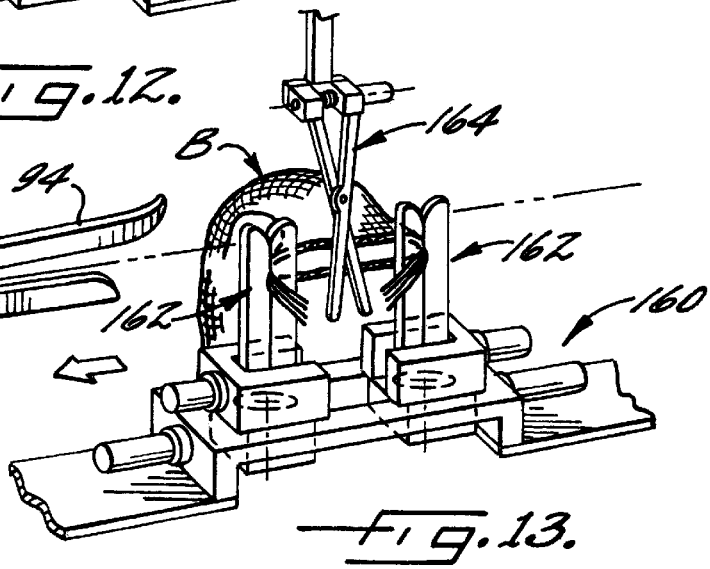

FIGS. 10 through 13 depict a further embodiment of the invention for use with sock blanks of the type described in U.S. Pat. No. 6,003,345 and shown in FIG. 10. The sock blank B includes a bridge or handle H that extends along a diameter across the toe opening of the open toe end. As described in the '345 patent, the handle H can be formed in various ways, including knitting. The handle H is positioned such that its opposite ends attach to the edge of the toe opening at locations that are to be spread apart to flatten the toe end into the appropriate configuration for sewing the toe end closed; for example, the handle H can be attached to the points P and P' on the sock blank shown in FIG. 1A. Accordingly, by severing the handle H at about its midpoint, a pair of handles are formed that can be pulled apart to flatten the toe end for sewing. This is illustrated in FIGS. 11 through 13. FIG. 11 shows a spreader device 160 that includes a pair of grippers 162 each having a pair of gripping fingers 163 that are movable toward and away from each other. The gripping fingers 163 receive the handle H at two spaced apart locations as in FIG. 11 and grip the handle as in FIG. 12. The spreader device 160 can then be moved away from the inner tube 24 to remove the sock blank therefrom.

The handle H is cut at a point between the grippers 162 by a suitable cutting device 164, thus forming a pair of handles attached to the sock blank at points on diametrically opposite sides of the toe opening. The grippers 162 are moved farther apart to spread the toe end into a flattened configuration, and the spreader device is conveyed to a sewing machine to feed the sock blank thereinto. In FIGS. 11–13, the sock blank is shown being removed from inside a tube 124 by gripping the handle H in the grippers 162 of the spreader device. In this embodiment of the invention, the sock blank can be rotationally oriented solely by using the handle H, and the sock blank is not inverted over the tube and rotationally oriented using the sensor system and clamping mechanism as previously described. Instead, the sock blank is inverted prior to bringing it into the tube 124, with the toe end of the blank adjacent the end of the tube. The spreader device 160 grabs the handle H and the cutting device 164 severs the handle, and the spreader device then pulls the two halves of the handle apart. This causes the sock blank to automatically become rotationally oriented. The sock blank can then be fed into a sewing machine.

It will be recognized, however, that the sock blank potentially could be in a position rotated 180 degrees from the desired position. Accordingly, another embodiment of the invention combines the use of the sensor system and rotatable clamping mechanism for orienting the sock blank as described in connection with FIGS. 2 through 9, and the use of the handle H for spreading and flattening the sock blank for sewing. The sock blank is inverted over the inner tube 24 and the sensor system and clamping mechanism are used for orienting the sock blank with the extended toe portion in a predetermined orientation such as at top dead center of the inner tube on which the sock blank is supported. If for any reason the rotational position of the sock blank is slightly inaccurate, the position will be "fine-tuned" by pulling the two halves of the handle apart.

Many modifications and other embodiments of the invention will come to mind to one skilled in the art to which this invention pertains having the benefit of the teachings presented in the foregoing descriptions and the associated drawings. Therefore, it is to be understood that the invention is not to be limited to the specific embodiments disclosed and that modifications and other embodiments are intended to be included within the scope of the appended claims. Although specific terms are employed herein, they are used in a generic and descriptive sense only and not for purposes of limitation.

What is claimed is:

1. A method for automatically orienting and positioning an open toe end of a tubular sock blank so that the toe end can be closed in an automatic sewing machine, the toe end defining a toe opening encircled by an edge of the blank made up of first and second edge portions that are joined at junctures located on generally diametrically opposite sides of the toe opening, the first edge portion delimiting an extended toe portion of the sock blank extending axially beyond the second edge portion when the sock blank is opened up into a generally tubular shape, the method comprising:

supporting the sock blank such that at least the toe end of the sock blank is opened up into a generally tubular shape extending lengthwise along a longitudinal axis;

rotating the generally tubular-shaped toe end of the sock blank about said longitudinal axis until said junctures between the first and second edge portions of the toe opening are aligned along a predetermined transverse axis that is generally perpendicular to said longitudinal axis;

gripping opposite portions of the toe end proximate said junctures and moving the opposite portions apart along said transverse axis to spread the toe end of the sock blank into a flattened configuration having the first and second edge portions overlying and generally aligned with each other; and moving the flattened toe end into said automatic sewing machine to sew the edges together.

2. The method of claim 1, wherein the sock blank is sleeved over a tube to position the sock blank in a generally tubular shape, and wherein the sock blank is rotated about the tube to position the toe end for spreading and flattening.

3. The method of claim 2, wherein the sock blank has a predetermined axial length and is sleeved over the tube by positioning the sock blank inside the tube with a top end of the sock blank adjacent the end of the tube and the opposite toe end inside the tube spaced axially from the end thereof, pulling the top end of the sock blank out the end of the tube and inverting the top end over the end of the tube, gripping the inverted top end of the sock blank and moving the top end axially along a predetermined length of the tube less than the length of the sock blank such that the sock blank is inverted and sleeved over the tube with the toe end of the sock blank extending beyond the end of the tube.

4. The method of claim 2, wherein the sock blank is gripped by clamp members that clamp the sock blank against the tube, the sock blank being rotated by rotating the clamp members about the tube.

5. The method of claim 1, wherein an optical sensor and an optical target are disposed one inside and the other outside the open tubular-shaped toe end of the sock blank to define a line of sight therebetween, the sensor and the target being positioned axially with respect to the toe end such that rotation of the sock blank causes the toe portion to block the line of sight in some rotational positions of the sock blank and to move free of the line of sight in other rotational positions of the sock blank, and wherein the sensor detects when one edge of the toe portion breaks the line of sight in a first rotational position of the sock blank and when an opposite edge of the toe portion breaks the line of sight in a second rotational position of the sock blank, and a properly oriented position of the sock blank is determined based on the first and second rotational positions.

6. The method of claim 5, wherein the line of sight defined by the sensor and target is radial with respect to the tubular-shaped open toe end and is generally perpendicular to the predetermined transverse axis, and the sock blank is rotated to a position midway between the first and second rotational positions to orient the sock blank relative to the transverse axis for spreading into the flattened configuration.

7. The method of claim 6, wherein the sock blank is sleeved over a tube to position the sock blank in a generally tubular shape with the open toe end extending beyond an end of the tube, and wherein the one of the sensor and target that is disposed within the tubular-shaped open toe end is disposed outside the tube proximate a longitudinal axis thereof.

8. The method of claim 7, wherein the one of the sensor and target is disposed on a member of a spreader device that is axially inserted into the open toe end of the sock blank, the spreader device having a pair of spreader fingers that are movable between collapsed and spread positions toward and away from each other along the direction of the transverse axis, the spreader device being inserted into the open toe end with the fingers in the collapsed positions and the fingers then being moved away from each other into the spread positions to spread and flatten the open toe end of the sock blank.

9. The method of claim 8, wherein the spreader device is moved to carry the sock blank in the spread and flattened configuration to said automatic sewing machine.

10. The method of claim 1, further comprising providing a bridge extending across the open toe end of the sock blank between two diametrically opposite portions thereof located on either side of the toe portion, and wherein the toe end is spread and flattened by severing the bridge at about a midpoint thereof so as to define a pair of handles respectively attached to the diametrically opposite portions, and grasping the handles and pulling them away from each other along said transverse axis.

11. The method of claim 1, wherein the sock blank is sleeved over a tube to position the sock blank in a generally tubular shape with the open toe end extending beyond an end of the tube, the sock blank is rotated about the tube to detect predetermined features of the toe end and to position the toe end in a predetermined position based upon detection of said features, the toe end is spread and flattened by axially inserting a spreader device into the open toe end and spreading a pair of fingers of the spreader device apart along the transverse axis to spread and flatten the toe end, and the spreader device is carried away from the tube to remove the sock blank from the tube and to transport the sock blank into said automatic sewing machine.

12. The method of claim 1, wherein the step of supporting the sock blank in said tubular configuration comprises:

moving the sock blank in an axially elongated configuration into a tube such that one end of the sock blank is adjacent an end of the tube;

positioning a vacuum device coaxially surrounding the end of the tube and applying vacuum to the vacuum device so as to attempt to draw said one end of the sock blank out from the tube in a tubular configuration into an annular space within the vacuum device, the amount of vacuum applied being sufficient to cause a cuff end of the sock blank to be drawn into said annular space but insufficient to cause a toe end of the sock blank having a thickened clip to be drawn into said annular space;

detecting whether or not the sock blank has been drawn into said annular space in the vacuum device;

if the sock blank has not been drawn into said annular space, causing the sock blank to be reversed end-to-end so that an opposite end of the sock blank is adjacent the end of the tube, and repeating the steps of positioning and operating the vacuum device to draw the opposite end into said annular space in the vacuum device; and if the sock blank has been drawn into said annular space, fixing the sock blank relative to the vacuum device and causing relative axial movement between the tube and the vacuum device so as to invert the sock blank over the outside of the tube.

13. The method of claim 12, wherein the step of detecting whether the sock blank has been drawn into said annular space in the vacuum device comprises:

moving a clamp member within the vacuum device into a position for clamping a sock blank in said annular space to prevent withdrawal of the sock blank therefrom;

causing relative axial movement between the tube and the vacuum device such that if the sock blank has been successfully clamped by the clamp member the sock blank will be inverted over the outside of the tube; and detecting whether or not the sock blank is inverted over the outside of the tube after said relative axial movement.

14. The method of claim 13, wherein the step of detecting whether or not the sock blank is inverted over the outside of the tube comprises moving a sensor relative to the tube such that the sensor will contact the outside of the tube and provide a signal indicating such contact if the sock blank has not been successfully inverted over the outside of the tube, and using the signal provided by the sensor to determine whether the sock blank is inverted over the outside of the tube.

15. An apparatus for automatically orienting and positioning an open toe end of a tubular sock blank so that the toe end can be closed in an automatic sewing machine, the toe end defining a toe opening encircled by an edge of the blank made up of first and second edge portions that are joined at junctures located on generally diametrically opposite sides of the toe opening, the first edge portion delimiting an extended toe portion of the sock blank extending axially beyond the second edge portion when the sock blank is opened up into a generally tubular shape, the apparatus comprising:

a tube for supporting the sock blank sleeved thereover such that the sock blank extends lengthwise along a longitudinal axis of the tube with the toe end opened up into a generally tubular shape and with the edge portions of the toe opening extending beyond an end of the tube;

at least one clamp member operable to engage the sock blank on the tube and having an actuator operable to cause the clamp member to rotate the sock blank and the toe end thereof about the longitudinal axis of the tube;

a sensor system positioned proximate the end of the tube and operable for detecting at least one predetermined feature of the toe end and for providing a signal upon detection of said feature by the sensor system;

a processor arranged to receive the signal from the sensor system and signals from the actuator and to control the rotation of the clamp member in response to said signals so as to position the toe end in a nominal position in which said junctures between the first and second edge portions are aligned along a transverse axis that is generally perpendicular to the longitudinal axis of the tube; and a spreader device operable to move into the open toe end of the sock blank to a position proximate the end of the tube and to grip opposite portions of the toe end proximate said junctures and move the opposite portions apart along said transverse axis to spread the toe end of the sock blank into a flattened configuration having the first and second edge portions overlying and generally aligned with each other, the spreader device being further operable to remove the sock blank from the tube and to move the sock blank to said automatic sewing machine for feeding the flattened toe portion of the sock blank thereinto.

16. The apparatus of claim 15, wherein the sensor system comprises an optical sensor and an optical target disposed one inside and the other outside the open tubular-shaped toe end of the sock blank to define a line of sight therebetween, the sensor and the target being positioned axially with respect to the toe end such that rotation of the sock blank causes the toe portion to block the line of sight in some rotational positions of the sock blank and to move free of the line of sight in other rotational positions of the sock blank, the sensor system thereby detecting a rotational position of the toe portion relative to said transverse axis.

17. The apparatus of claim 16, wherein the sensor detects when one edge of the toe portion breaks the line of sight in a first rotational position of the sock blank and when an opposite edge of the toe portion breaks the line of sight in a second rotational position of the sock blank, and wherein the processor is operable to determine the nominal position of the sock blank based on the first and second rotational positions.

18. The apparatus of claim 16, wherein the one of the sensor and target is disposed on a member of the spreader device.

19. The apparatus of claim 15, the spreader device having a pair of spreader fingers that are movable between collapsed and spread positions toward and away from each other in a defined plane of movement, the spreader device being movable axially relative to the tube for insertion of the spreader device into the open toe end with the fingers in the collapsed positions and with the defined plane of movement of the fingers aligned with said transverse axis, after which the fingers are spread apart into the spread positions to spread and flatten the open toe end of the sock blank.

20. The apparatus of claim 19, wherein end portions of the spreader fingers are barb-shaped for preventing a clip region of the toe end located axially outward of an intended sew line of the toe end from sliding over said end portions when the toe end is spread into a flattened configuration by the fingers.

21. The apparatus of claim 15, wherein the spreader device is mounted on a conveyor device so as to be movable in a direction generally transverse to the axis of the tube for carrying the spread and flattened sock blank to said automatic sewing machine.

22. The apparatus of claim 15, wherein said at least one clamp member comprises a pair of clamp members mounted on a structure that coaxially surrounds the tube and is rotatably driven about the tube axis, the clamp members being movable generally radially with respect to the tube to engage the sock blank from generally opposite sides thereof.

23. The apparatus of claim 22, wherein each clamp member has an arcuate friction surface for engaging a circumferential sector of the sock blank.

24. The apparatus of claim 15, wherein the tube is axially movable, and further comprising at least one sensor positioned to be contacted by the tube when the tube is axially moved into a predetermined position, the sensor being positioned such that contact between the sensor and the tube is prevented by the sock blank if the sock blank is inverted over the outside of the tube.

25. The apparatus of claim 15, adapted for use with a sock blank having a pair of handles respectively attached to two diametrically opposite portions of the open toe end located on either side of the toe portion, and wherein the spreader device includes a pair of grippers operable to grip each of the handles and to move apart along the direction of said transverse axis for spreading and flattening the sock blank for sewing.

26. The apparatus of claim 25, wherein the spreader device is mounted on a conveyor device so as to be movable in a direction generally transverse to the axis of the tube for carrying the spread and flattened sock blank to said automatic sewing machine.

* * * * *